US006407019B1

(12) United States Patent
Schäfer et al.

(10) Patent No.: US 6,407,019 B1
(45) Date of Patent: Jun. 18, 2002

(54) PREFORM MATERIAL FOR MANUFACTURING A PROTECTIVE GARMENT, AND METHOD FOR MANUFACTURING IT

(75) Inventors: Werner Schäfer, Birkenau; Hans Rettig, Heppenheim; Peter Grynaeus, Birkenau, all of (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/387,672

(22) Filed: Aug. 31, 1999

(30) Foreign Application Priority Data

Sep. 1, 1998 (DE) ..... 198 39 758

(51) Int. Cl.[7] ..... D04H 1/46; B32B 5/26; B32B 27/12

(52) U.S. Cl. ..... 442/408; 442/319; 442/361; 442/381; 442/394; 442/397; 442/415

(58) Field of Search ..... 442/327, 408, 442/394, 397, 415, 361, 319, 381

(56) References Cited

U.S. PATENT DOCUMENTS

| | | | | |
|---|---|---|---|---|
| 5,050,241 A | * | 9/1991 | Flowers et al. | 2/81 |
| 5,236,769 A | | 8/1993 | Paire | 428/196 |
| 5,279,878 A | * | 1/1994 | Fottinger et al. | 428/102 |
| 5,534,325 A | * | 7/1996 | Jorder et al. | 428/102 |
| 5,595,817 A | * | 1/1997 | Schafer et al. | 428/283 |

FOREIGN PATENT DOCUMENTS

| | | |
|---|---|---|
| DE | 38 19362 | 12/1989 |
| EP | 0 323 763 | 7/1989 |
| EP | 0 364 370 | 4/1990 |
| EP | 0 501 080 | 9/1992 |
| EP | 0 819 389 | 1/1998 |
| WO | 97/22385 | 6/1997 |

OTHER PUBLICATIONS

"Herstellungs–und Prüfungsbeschreibung für eine universelle Fuerwehrschutzkleidung" (German HuPF–manufacturing and testing specification for a universal firefighter's protective garment),* no date given.

* cited by examiner

*Primary Examiner*—Terrel Morris
*Assistant Examiner*—Ula C. Ruddock
(74) *Attorney, Agent, or Firm*—Kenyon & Kenyon

(57) ABSTRACT

A preform material for manufacturing a protective garment having a top material, in particular a firefighter's protective garment. The material is made of an insulating lining made up of an at least two-ply water-jet-consolidated nonwoven fabric having a weight per unit area of 80 g/m$^2$ or lighter for each individual ply, a lining material having a weight per unit area of 120 g/m$^2$ or lighter, that is quilted to the at least two-ply nonwoven fabric; and a semipermeable membrane, constituting a moisture barrier. After the at least two-ply water-jet-consolidated nonwoven fabric has been quilted to the lining material, the semipermeable membrane is laminated onto the outer side, facing away from the lining material, of the nonwoven fabric ply and has a weight per unit area of 20 to 30 g/m$^2$.

10 Claims, 1 Drawing Sheet

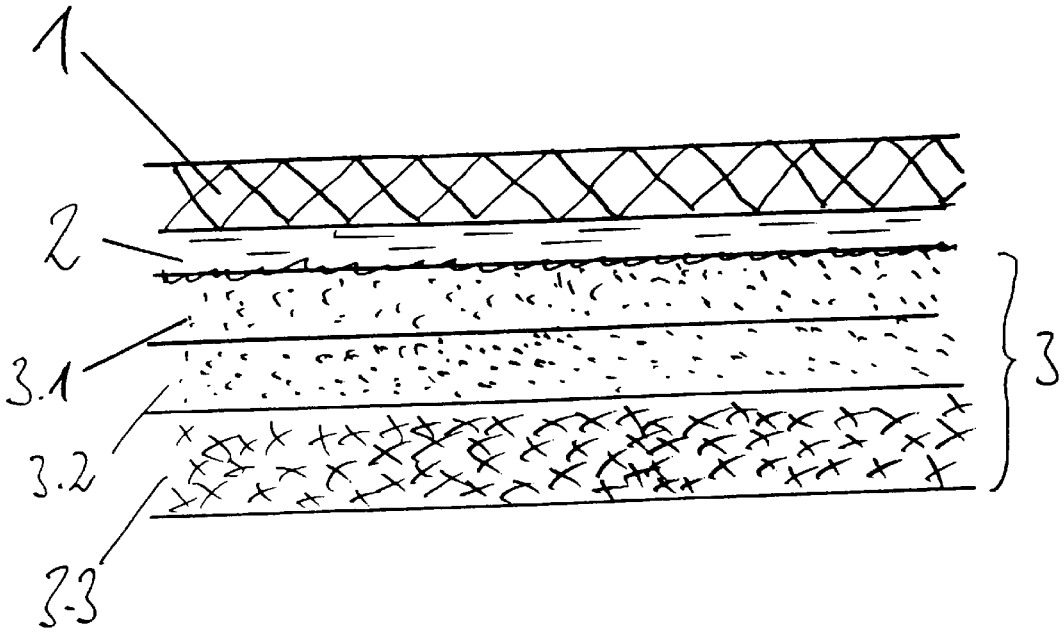
Fig.

PREFORM MATERIAL FOR MANUFACTURING A PROTECTIVE GARMENT, AND METHOD FOR MANUFACTURING IT

BACKGROUND OF THE INVENTION

The invention relates to a preform material for manufacturing a protective garment having a top material such as, in particular, a firefighter's protective garment, which allows single-layer processing together with a top material. The invention also relates to a method for manufacturing the preform material.

In order to be suitable as a single-layer material for use as a firefighter's service garment, a preform of this kind must protect the wearer from the effect of heat due to radiation and flame, i.e. it must not be flammable. In addition, the firefighter's service garment must protect the wearer from the penetration of firefighting water and liquid chemicals, and at the same time must be able to "breathe." The requirements are defined in EN 469 for the German HuPF (manufacturing and testing specification for a universal firefighter's protective garment). According to HuPF, firefighter's jackets fundamentally include the following essential components: a top material, usually made of aramid or amideimide; a moisture barrier, often a semipermeable membrane laminated onto a textile support; and an insulating lining, usually a quilted composite made of heat resistant ("HR") tufted nonwoven fabric or HR knitted fabric with a lining material made of HR fibers.

The moisture barrier can be laminated directly onto the top material, but usually it is incorporated, as a separate functional layer comprising membrane and support, between the top material and insulating lining.

Also known are laminates of membranes with an insulating lining based on tufted nonwoven fabrics with lining material, in which a lining material having a weight per unit area of 120 to 150 g/m$^2$ is quilted to a tufted nonwoven material having a weight per unit area of 200 to 260 g/m$^2$, the weight per unit area (200 to 260 g/m$^2$) of the tufted nonwoven fabric composed of HR fibers and being necessary in order to ensure heat absorption values. Instead of the laminated membrane, a separate moisture barrier comprising membranes plus supports, having a weight per unit area of 120 to 150 g/m$^2$, can be provided.

Although the combinations described above conform to the specifications under EN 469 and HuPF, they are generally relatively expensive and inflexible, with the result that they compromise the comfort of the wearer.

SUMMARY OF THE INVENTION

The present invention provides a lightweight and very flexible layer, which can therefore easily be processed in one layer, having multifunctional properties. It is composed of an insulating lining made up of an at least two-ply water-jet-consolidated nonwoven fabric having a weight per unit area of 80 g/m$^2$ or lighter for each individual ply, that is quilted to a lining material having a weight per unit area of 120 g/m$^2$; and a semipermeable membrane as moisture barrier, which, after quilting of the at least two-ply water-jet-consolidated nonwoven fabric, is laminated onto the outer side, facing away from the lining material, of the nonwoven fabric ply at a weight per unit area of 20 to 30 g/m$^2$.

The multiple-ply structure of the quilted insulating lining made of lightweight water-jet-consolidated nonwoven fabrics makes possible, because of the high level of air inclusion and the resulting enhanced insulating effect, a definite reduction in the overall weight and thus substantially improved wearer comfort due to the lower weight of the overall composite.

The preform material achieves an overall weight per unit area of 270 to 280 g/m$^2$, i.e., initially 160 g/ml$^2$ with two plies of a water-jet-consolidated nonwoven fabric of 80 g/m$^2$ each, which then, quilted to a lining material of 120 g/m$^2$, yields a total weight of no more than 280 g/m$^2$.

The surface parameters of the 200–260 g/m$^2$ nonwoven fabric necessary to conform to thermal insulation values per EN 366 (heat penetration on exposure to a 40 kW/m$^2$ radiation source) and EN 367 (heat penetration resulting from flame action) are nevertheless achieved.

Instead of two plies with a weight per unit area of 80 g/m$^2$ each, it is also possible to use three plies of a water-jet-consolidated nonwoven fabric of 50 g/m$^2$ each, and to quilt them to the lining material. This results in a total weight of 270 g/m$^2$. The additional ply means that sufficient insulating efficiency is achieved despite the reduction in weight per unit area.

Laminating the semipermeable membrane onto the outer layer of nonwoven fabric allows the preform material, with an increase of 20 to 30 g/m$^2$ in weight per unit area, simultaneously to perform the function of a moisture barrier while maintaining the aforementioned wearer comfort.

The water-jet-consolidated nonwoven fabric can advantageously be made from m- or p-aramid fibers, melamine resin fibers, phenol resin fibers, polyimide fibers, polybenzimidazole ("PB") fibers, or a mixture of these fiber materials.

It is furthermore possible for the individual plies of the water-jet-consolidated nonwoven fabric to comprise different aforementioned materials.

Advantageously, the membrane is laminated using a moisture-crosslinking polyurethane adhesion compound.

A further problem that is present is that of making available a method for manufacturing a preform material that is lightweight, highly flexible, and can conveniently be processed in single-ply fashion, and has multifunctional properties. Joining two water-jet-consolidated individual plies of a nonwoven fabric to a lining material by quilting, and then coating the side of the nonwoven fabric with a semipermeable membrane, at the maximum weights per unit area respectively indicated, creates a preform material having a greatly reduced overall weight with considerably improved wearer comfort.

Joining the membrane to the outer nonwoven fabric layer using a moisture-crosslinking polyurethane adhesion compound has the advantage that wearer comfort can be maintained.

BRIEF DESCRIPTION OF THE FIGURE

The drawing depicts a cross section through a firefighter's protective garment.

DETAILED DESCRIPTION

The protective garment includes a top material 1 that is laid onto a semipermeable membrane 2 substantially without connection thereto. Membrane 2 is semipermeable, i.e. the membrane is both permeable to water vapor, and yet also is water-tight. The pore size can be selected so that other liquids also do not pass through the membrane. This results in a moisture barrier for firefighting water or other chemicals.

Membrane 2 is laminated, using moisture-crosslinking polyurethane adhesion compound, to a nonwoven fabric 3, indicated by the irregularly drawn contact region between membrane 2 and insulating lining 3.

Insulating lining 3 is made of a two-ply nonwoven fabric 3.1 and 3.2, and a lining material 3.3. The two-ply nonwoven fabric 3.1 and 3.2 is made of two individual plies 3.1 and 3.2 with a ply weight of 80 g/m$^2$ or lighter. The individual plies are each water-jet-consolidated within themselves.

Lining material 3.3 has a weight per unit area of 120 g/m$^2$ or lighter, and is embodied in known fashion as a tufted nonwoven fabric or knitted fabric.

The insulating lining is manufactured by quilting lining material 3.3 to individual plies 3.1, 3.2 of the water-jet-consolidated nonwoven fabric 3.1 and 3.2. (This quilting is not depicted in the drawing.) The quilting yields a preform material that can be processed as a single layer, and that can be joined at appropriate points to the top material in known fashion.

After individual plies 3.1, 3.2 and lining material 3.3 have been quilted, the semipermeable membrane 2 is laminated onto the outer nonwoven fabric ply, so that this insulating lining, with an increase in weight of only 20 to 30 g/m$^2$, simultaneously performs the function of a moisture barrier while maintaining wearer comfort.

Selection of the number of plies of the consolidated nonwoven fabric and of the lining material depends globally on the minimum total weight per unit area that must be achieved by the nonwoven fabric made of HR fibers; this must be 200 to 260 g/m$^2$ in order to achieve the desired heat-absorption values.

What is claimed is:

1. A preform material for manufacturing a protective garment having a top material comprising:

an insulating lining made up of an at least two-ply water-jet-consolidated nonwoven fabric having a weight per unit area less than or equal to 80 g/m$^2$, per each ply;

a lining material having a weight per unit area less than or equal to 120 g/m$^2$, that is quilted to the at least two-ply nonwoven fabric; and a semipermeable membrane, providing a moisture barrier, that, after the at least two-ply water-jet-consolidated nonwoven fabric has been quilted to the lining material, is laminated directly on a side of the nonwoven fabric ply facing away from the lining material, the semipermeable membrane having a weight per unit area of 20 to 30 g/m$^2$.

2. The preform as defined in claim 1, wherein the water-jet-consolidated nonwoven fabric is made of m- or p-aramid fibers.

3. The preform material as defined in claim 1, wherein the water-jet-consolidated nonwoven fabric is made of melamine resin fibers.

4. The preform material as defined in claim 1, wherein the water-jet-consolidated nonwoven fabric is made of phenol resin fibers.

5. The preform material as defined in claim 1, wherein the water-jet-consolidated nonwoven fabric is made of polyamideimide fibers.

6. The preform material as defined in claim 1, wherein the water-jet-consolidated nonwoven fabric is made of polyamide fibers.

7. The preform material as defined in claim 1, wherein the water-jet-consolidated nonwoven fabric is made of PB fibers.

8. The preform material as defined in claim 1, wherein the water-jet-consolidated nonwoven fabric is made of a mixture of fibers selected from the group consisting of m-aramid, p-aramid, melamine resin, phenol resin, polyamideimide, and polyamide fibers.

9. The preform material as defined in claim 1, wherein the individual plies of the water-jet-consolidated nonwoven fabric are made of different materials selected from the group consisting of m-aramid, p-aramid, melamine resin, phenol resin, polyamideimide, and polyamide fibers.

10. The preform material as defined in claim 1, wherein the membrane is laminated using a moisture-crosslinking polyurethane adhesion compound.

* * * * *